United States Patent [19]

Grauleau et al.

[11] Patent Number: 4,459,323

[45] Date of Patent: Jul. 10, 1984

[54] PROCESS FOR PRODUCING AN IMPREGNATED CATHODE WITH AN INTEGRATED GRID, CATHODE OBTAINED BY THIS PROCESS AND ELECTRON TUBE EQUIPPED WITH SUCH A CATHODE

[75] Inventors: Didier Grauleau; Arvind Shroff, both of Paris, France

[73] Assignee: Thomson-CSF, Paris, France

[21] Appl. No.: 254,265

[22] Filed: Apr. 15, 1981

[30] Foreign Application Priority Data

Apr. 18, 1980 [FR] France ..... 80 08708

[51] Int. Cl.[3] ..... H01J 9/04; H01J 1/46

[52] U.S. Cl. ..... 427/78; 427/122; 427/126.4; 427/124; 427/259; 427/282; 427/226

[58] Field of Search ..... 427/78, 259, 122, 124, 427/126.4, 282, 226

[56] References Cited

U.S. PATENT DOCUMENTS 3,694,260 5/1970 Beggs ..... 427/78

4,302,702 11/1981 Montgaillard ..... 313/348

FOREIGN PATENT DOCUMENTS 2390825 12/1978 France .

*Primary Examiner*—John D. Smith

*Attorney, Agent, or Firm*—Roland Plottel

[57] ABSTRACT

A complementary grid made from a volatile material is formed on the surface of the cathode, which is then covered with the material of the grid (parts 5 and 6). After the volatilization of the complementary grid there leaves an integrated grid (part 6) on this surface.

6 Claims, 14 Drawing Figures

PROCESS FOR PRODUCING AN IMPREGNATED CATHODE WITH AN INTEGRATED GRID, CATHODE OBTAINED BY THIS PROCESS AND ELECTRON TUBE EQUIPPED WITH SUCH A CATHODE

BACKGROUND OF THE INVENTION

The invention relates to a process for producing cathodes with integrated grids.

The use of cathodes of this type has been made necessary by the continual increase in the power level of electron tubes, particularly for ultra-high frequencies, in which the power of the electron beam has become such that the fraction of the latter intercepted by the grids placed on its path can be sufficient to considerably deteriorate their characteristics (dimensions, alignment, mechanical behaviour) and even prejudice their service life.

One of the main problems which occur in this connection is that of the first two grids, generally called $G_1$ and $G_2$. These grids, which respectively ensure the control and acceleration of the electron beam emitted by the cathode, must have aligned bars, the first casting a shadow on the second, thereby preventing an excessive interception of the beam by the latter. When the first of these grids $G_1$ is incorporated into the cathode, this condition is more easily fulfilled. Due to its integration, grid $G_1$ is protected from such an interception.

According to this procedure, grid $G_1$ is etched on the emissive face of the cathode on which solid portions constitute areas which are protected from the emission surrounding the emissive areas in accordance, for example, with a system of meshes arranged in rectangular columns and lines. The alignment of the second grid $G_2$ with the first is then made much easier.

The problems include that of the non-emissivity of the incorporated or integrated grid, despite its proximity to areas which are rich in emissive material and in particular the problem of the choice of its constituent material for this purpose.

In the prior art this problem has been solved in various ways. Various process have also been proposed for producing cathode with integrated grids.

BRIEF SUMMARY OF THE INVENTION

The invention relates to such a process which can be used in the case of impregnated cathodes constituted, as in the prior art, by a solid member made from a sintered metal powder with a high melting point into which is incorporated a powder of an emissive substance, generally a barium compound.

The process according to the invention is applied to the formation of the first grid integrated into such a cathode. According to one of its variants, it is applicable to the incorporation of the second of the grids of cathode systems, namely grid $G_2$, to which reference was made hereinbefore.

The invention also covers the cathodes produced by this process, as well as the electron tubes equipped therewith.

The invention therefore relates to a process for producing an impregnated cathode with an integrated grid, comprising a solid member made from a sintered metal impregnated with a powder of an electron-emissive material and a grid incorporated into said cathode on its face which, in operation, emits electrons, the grid being made from a non-emissive material at the operating temperature of the cathode, comprising the steps of forming on the said face a provisional grid, constituted by reserves, complementary to that incorporated in the cathode, by means of a volatile metal with a high vapour pressure, covering the complete face, including the provisional grid, with the material of the grid to be incorporated and bringing about the volatilization of the material of the reserves.

BRIEF DESCRIPTION OF THE DRAWINGS

The invention is described in greater detail hereinafter relative to non-limitative embodiments and the attached drawings, showing FIGS. 1*a*, 1*b*, 1*c* and 2*a*, 2*b*, 2*c*, the successive stages of the production of impregnated cathodes with integrated grids in accordance with two prior art processes, FIGS. 3*a* to 3*f* the stages of the process according to the invention for producing an impregnated cathode with an integrated grid, FIGS. 4*a* and 4*b* the stages of a variant of the invention process applicable to the integration of two grids into the same cathode.

DETAILED DESCRIPTION OF THE PREFERRED EMBODIMENTS

Figure 1A:
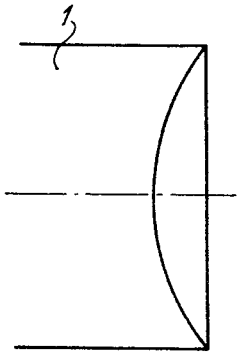
Figure 1B:
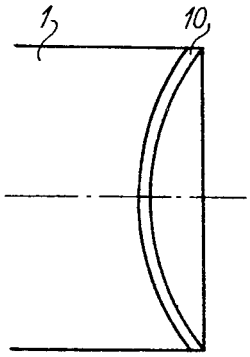
Figure 1C:
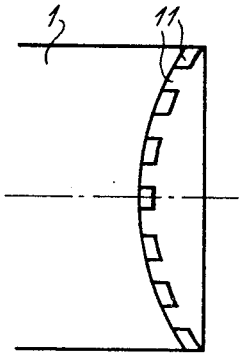

According to the process of FIGS. 1*a*, *b* and *c* onto an impregnated cathode member 1 (FIG. 1*a*) is deposited a layer 10 (FIG. 1*b*) of the material of the non-emissive grid to be produced, e.g. tugsten. This is followed by the etching by photogravure in cathode 1 of the design of the grid, whose bars which define the meshes carry reference numeral 11. The selected emissive material member 1 is then impregnated. This involves the impregnation of member 1 taking place after etching and layer 10 having a sufficient thickness to permit an appropriate cleaning of bars 11 following said impregnation.

Figure 2A:
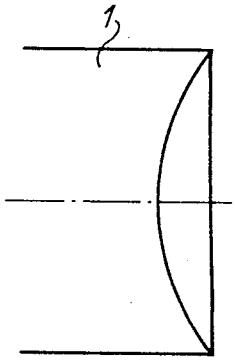
Figure 2B:
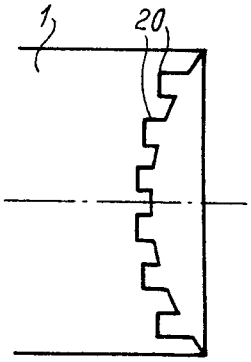
Figure 2C:
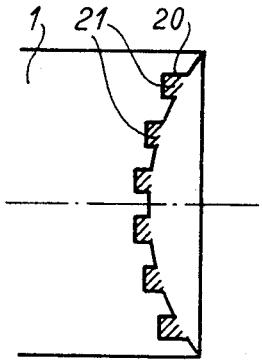

According to another prior art process shown in FIGS. 2*a*, *b* and *c*, the design of the grid is machined into the cathode member 1 (FIG. 2*a*), as shown in FIG. 2*b*, and then the grooves 20 resulting from this machining filled with non-emissive material to form the bars 21 of the grid.

These processes either involve etching or complex and difficult machining.

The process of the invention is illustrated by FIGS. 3*a* to 3*f*. A volatile material with a high vapour pressure is used under the conditions to be described hereinafter.

In a first operation (FIG. 3*a*) a grid similar to that desired is produced on the emissive face 2 of the cathode. Grid (3) is positioned in a tool (3*a*), and the cathode (1) is placed on the grid (3) of the tool, so that the emissive face (2) of the cathode is in close contact with the grid (3). Grid 3 subsequently fulfils the function of a mask. It is made from a refractory metal such as molybdenum, but can also be of graphite. A volatile material with a high vapour pressure, such as magnesium, zinc, cadmium, etc. is then evaporated from a heated crucible 30 in accordance with any known method (FIG. 3*b*) onto face 2, provided with grid 3. One method involves vacuum evaporation, e.g. within an enclosure 31. The deposit has a thickness of approximately 20 to 50 micrometers.

The mask 3 is then removed by removing the tool (3*a*) away from the cathode (2), leaving behind on face 2 a grid complementary to that which is to be produced (FIG. 3*c*) formed from volatile material reserves 4. The grid material is then deposited by any known process, e.g. by spraying onto said reserves.

This spraying process uses a gaseous discharge in an ampoule containing a gaseous compound of the material to be deposited. The member to be covered is raised to a potential attracting the ions from the material in question.

Figure 3A:
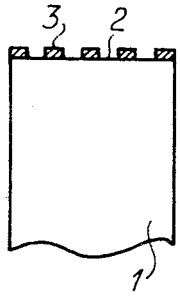
Figure 3B:
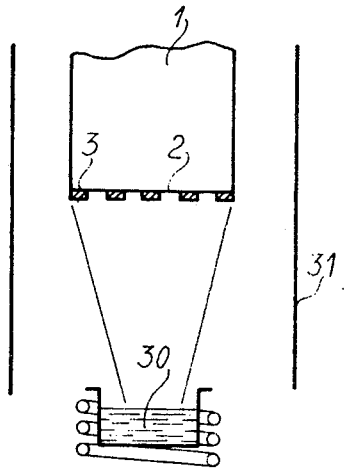
Figure 3C:
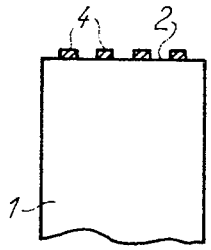
Figure 3D:
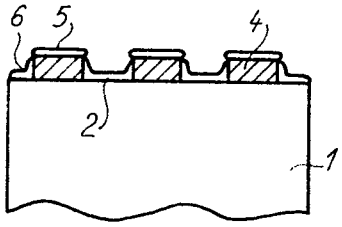

This leads to the structure shown in FIG. 3*d* on which it is possible to see with the same reference numerals, the elements of FIG. 3*c* and in particular the reserves 4. The grid material covers these reserves, as well as the gaps between the latter. This can be seen in FIG. 3*d* by means of reference numerals 5 and 6.

Figure 3E:
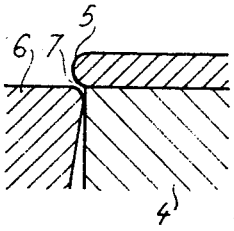

FIG. 3*e* shows in greater detail the structure of the latter deposit, particularly the relative positions of parts 5 and 6, between which there is a gap 7.

Figure 3F:
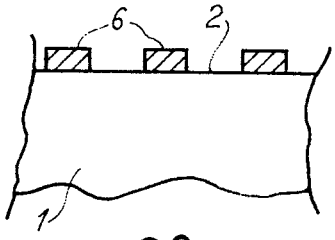

The reserves 4 are then eliminated by heating at 200° to 300° C. Reserves 4 volatilize, whilst tearing parts 5 of the metal film. As can be seen in FIG. 3*f*, the part 6 constituting the integrated grid are left behind on face 2.

The material forming the grid is chosen from among those with a high work function and which are therefore non-emissive at the cathode operating temperature, even when in the vicinity of barium-rich areas. Within the scope of the invention and without this being in any way limitative, they are for example binary mixtures such as W, Zr or W, $ZrSi_2$ or W, $ZrB_2$ or W, ZrC or even W, WC.

The present process makes it possible, by means of a few supplementary operations, to integrate the second grid of cathode systems into the cathode, i.e. grid $G_2$ to which reference was made hereinbefore. This automatically solves the problem of the grid alignment and interception is eliminated. The choice of a material with a high work function ensures the non-emissivity of the second grid like the first grid.

These operations are as follows in the indicated order, with particular references to FIGS. 4*a* and 4*b*.

Figure 4A:
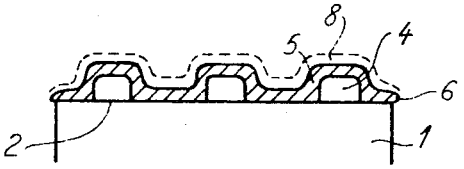
Figure 4B:
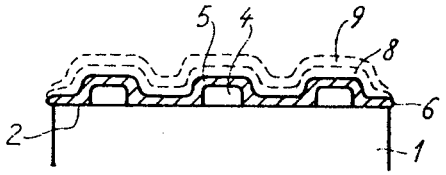

Before the elimination of reserves 4, a carbon layer 8 with a thickness of 10 to 20 micrometers is deposited, e.g. by spraying on parts 5 and 6 formed from the metal constituting the first grid (FIG. 4*a*). A thick layer 9 of 50 to 100 micrometers of boron nitride BN or alumina $Al_2O_3$ (FIG. 4*b*) is then deposited on the said layer, e.g. by the same process.

Finally, on layer 9 are deposited a further carbon layer having substantially the same thickness as the first carbon layer, and thereon a layer of the non-emissive material constituting the second grid, which can be the same as that used for forming the first grid. There is no drawing relating to the two latter stages, because they involve operations identical to the deposition of the aforementioned layer 8 and layer 5, 6 in FIG. 3*d*.

Layer 9 serves to insulate the two grids from one another. The carbon layer 8 and that subsequently deposited on layer 9 have a chemical separation function between the alumina layer and the non-emissive metals forming the grids. The presence of these carbon layers also facilitates the break between parts 5 and 6 at the time of the volatilization of material of reserves 4. The materials referred to hereinbefore for the formation of layers such as 9 are given in a preferred, but non-limitative manner. In a general manner, they can be chosen from among the electrical insulating materials.

Finally, the reserves 4 are eliminated by evaporation as in the final operation of the process for the production of cathodes with a single integrated grid.

In this way, a cathode with a double integrated grid is obtained. The two grids are superimposed and separated by the remaining parts of the carbon and alumina layers.

These cathodes, with either one or two integrated grids, can be used for the same purposes as in the prior art, namely for high power tubes for ultra-high frequencies and in particular travelling wave tubes, including cylindrical cathodes with a concave emissive surface like those shown.

What is claimed is:

1. A process for producing an impregnated cathode with an integrated grid, comprising a solid member made from a sintered metal impregnated with a powder of an electron-emissive material and a grid incorporated into said cathode on its face which, in operation, emits electrons, the grid being made from a non-emissive material at the operating temperature of the cathode, comprising the steps of forming on the said face a provisional grid, constituted by reserves, complementary to the grid that is to be incorporated in the cathode, by means of a volatile metal with a high vapour pressure, covering the complete face, including the provisional grid, with the material of the grid to be incorporated, and bringing about the volatilization of the material of the reserves thereby removing the reserves and any grid material thereon leaving the grid material which was deposited directly on the face.

2. A process according to claim 1 comprising the following successive operations:

(a) positioning on the surface (2) of the cathode a masking grid (3) like that which is to be produced and made from a refractory material;

(b) vacuum evaporation onto said surface of a volatile material so as to obtain reserves (4) in the meshes of the preceding masking grid;

(c) removing the masking grid;

(d) deposition by any known process of the grid material (6) onto the same surface;

(e) elimination of the reserves of volatile material by heating.

3. A process according to claim 1, wherein the volatile material is magnesium and the thickness of the reserves is 20 to 50 micrometers.

4. A process according to claim 1, wherein the material of the grid is a material having a high work function consisting of a mixture of tungsten and zirconium.

5. A process according to claim 1, further comprising between steps (d) and (e) the following successive operations:

(I) deposition of a carbon layer on the grid material of operation (d);

(II) deposition on the carbon layer of a layer of electrically insulating material;

(III) deposition on the preceding layer of a further carbon layer;

(IV) deposition on the carbon layer obtained by operation III of a layer of a material which is non-emissive at the cathode temperature, said process leading to a cathode with an integrated grid and having a second grid superimposed thereupon.

6. A process according to claim 5, wherein the material of the insulating layer is alumina $Al_2O_3$ and has a thickness between 50 and 100 micrometers, the carbon layers having a thickness between 10 and 20 micrometers.

* * * * *